US010751594B2

(12) United States Patent
Lee

(10) Patent No.: US 10,751,594 B2
(45) Date of Patent: Aug. 25, 2020

(54) SKATE SPINNER

(71) Applicant: Chang Ju Lee, Anyang-si (KR)

(72) Inventor: Chang Ju Lee, Anyang-si (KR)

( * ) Notice: Subject to any disclaimer, the term of this patent is extended or adjusted under 35 U.S.C. 154(b) by 130 days.

(21) Appl. No.: 15/793,961

(22) Filed: Oct. 25, 2017

(65) Prior Publication Data

US 2019/0076718 A1 Mar. 14, 2019

(30) Foreign Application Priority Data

Sep. 13, 2017 (KR) ..... 10-2017-0117405

(51) Int. Cl.

| | |
|---|---|
| ***A63B 69/00*** | (2006.01) |
| ***A63C 1/30*** | (2006.01) |
| ***A63B 22/00*** | (2006.01) |
| ***A63B 22/18*** | (2006.01) |

(52) U.S. Cl.

CPC ..... *A63B 69/0022* (2013.01); *A63B 22/0061* (2013.01); *A63C 1/30* (2013.01); *A63B 2022/185* (2013.01); *A63B 2244/183* (2013.01)

(58) Field of Classification Search

CPC ..... A63B 22/14; A63B 22/16; A63B 22/18; A63B 22/0056; A63B 22/0058; A63B 22/0061; A63B 69/0022; A63B 2022/185; A63B 2244/18; A63B 2244/183; A63B 26/033; A63C 1/30; A63C 3/00; A63C 1/36

See application file for complete search history.

(56) References Cited

U.S. PATENT DOCUMENTS 1,561,516 A * 11/1925 Glowa ..... A63B 25/06 36/28
2,810,213 A * 10/1957 Jonas ..... A43B 5/0419 36/1
3,279,794 A * 10/1966 Sherman ..... A63H 33/00 446/322
3,415,528 A * 12/1968 Herold ..... A63C 1/36 280/11.12
3,471,144 A * 10/1969 Dreux-Boucard ..... A63B 22/16 482/146
3,856,321 A * 12/1974 Solymosi ..... A63C 17/0033 280/842
4,206,558 A * 6/1980 Bivona ..... A43B 3/128 273/111
4,218,069 A * 8/1980 Baikie ..... A63C 1/02 280/11.12
4,247,996 A * 2/1981 Grapin ..... A43B 5/18 36/103
4,679,550 A * 7/1987 Quam ..... A61H 15/00 482/79
D315,584 S * 3/1991 Gappa ..... D21/688
D319,084 S * 8/1991 Bush ..... D21/688

(Continued)

*Primary Examiner* — Nyca T Nguyen

(74) *Attorney, Agent, or Firm* — Park, Kim & Suh, LLC

(57) ABSTRACT

A skate spinner comprises a platform configured for a user's foot to be placed thereon, and a support unit forming a lower part of the platform contacting a ground surface and having a curved protruded surface starting from a front end to a rear end thereof. The support unit includes plates each having a thickness equal to at least a thickness of an ice-skate blade and being aligned in a lateral direction of the skate spinner at a predetermined distance. An overall bottom surface of the plates contacting the ground surface has a spherical surface outline.

10 Claims, 9 Drawing Sheets

(56) References Cited

U.S. PATENT DOCUMENTS 5,135,450 A * 8/1992 Smith, IV ..... A63B 22/16 36/110
D365,610 S * 12/1995 Fraser ..... D21/688
5,643,164 A * 7/1997 Teff ..... A63B 22/16 482/146
6,318,001 B1 * 11/2001 Lee ..... A43B 13/184 36/27
6,421,935 B1 * 7/2002 Bartlett ..... A43B 7/00 36/132
6,551,225 B1 * 4/2003 Romero ..... A63B 21/0004 482/145
6,666,797 B1 * 12/2003 Martin ..... A63B 69/0093 482/146
7,011,612 B2 * 3/2006 Repking ..... A63B 22/16 482/142
7,291,103 B1 * 11/2007 Estwanik ..... A61H 1/0237 482/148
7,500,324 B1 * 3/2009 Power ..... A43B 13/145 36/132
D648,403 S * 11/2011 Hanifee ..... D21/688
8,397,404 B2 * 3/2013 Kim ..... A43B 5/00 36/103
8,529,411 B2 * 9/2013 DiGiovanni ..... A63B 23/085 482/79
8,734,308 B1 * 5/2014 Joslin ..... A63B 22/16 482/142
8,740,757 B1 * 6/2014 Fiorito ..... A63B 22/18 36/74
8,876,124 B2 * 11/2014 Pokupec ..... A43B 5/18 280/11.12
D778,377 S * 2/2017 Daniel ..... D21/688
9,700,756 B2 * 7/2017 Franche ..... A63B 22/16
9,713,360 B2 * 7/2017 Santos ..... A43B 23/00
2004/0009859 A1 * 1/2004 Gottlieb ..... A63B 21/0004 482/146
2004/0014571 A1 * 1/2004 Haynes ..... A63B 21/0004 482/142
2004/0023764 A1 * 2/2004 Repking ..... A63B 22/16 482/142
2004/0242382 A1 * 12/2004 Gibas ..... A43B 13/145 482/79
2005/0101441 A1 * 5/2005 Rosborough ..... A63B 22/16 482/51
2007/0099761 A1 * 5/2007 Edwards ..... A63B 69/0022 482/51
2008/0020856 A1 * 1/2008 Rosa ..... A63B 26/003 473/269
2009/0240174 A1 * 9/2009 Keimowitz ..... A47C 16/025 601/31
2010/0167886 A1 * 7/2010 Ko ..... A63B 21/0552 482/123
2010/0325919 A1 * 12/2010 Elbaz ..... A43B 5/18 36/103
2011/0263398 A1 * 10/2011 Klassen ..... A63B 22/16 482/146
2012/0146300 A1 * 6/2012 Giannatos ..... A63C 17/018 280/14.26
2013/0029815 A1 * 1/2013 Lu ..... A63B 21/0004 482/142
2013/0288866 A1 * 10/2013 Rainey ..... A63B 26/003 482/146
2013/0344926 A1 * 12/2013 Claudel ..... A63B 22/16 463/7
2014/0051553 A1 * 2/2014 Hetzel ..... A63B 23/0458 482/52
2014/0066262 A1 * 3/2014 Kennedy ..... A63B 71/0036 482/52
2014/0327217 A1 * 11/2014 Pokupec ..... A63C 1/32 280/11.18
2014/0336025 A1 * 11/2014 Rafferty ..... A63B 21/4043 482/142
2015/0018178 A1 * 1/2015 Carbone ..... A63B 71/0009 482/146
2015/0165266 A1 * 6/2015 Powers ..... A63B 22/16 482/142
2015/0351573 A1 * 12/2015 Heath ..... A63B 22/16 428/78
2016/0030800 A1 * 2/2016 McClure ..... A63B 22/16 482/146
2016/0038788 A1 * 2/2016 McMillan ..... G01L 5/18 73/488
2016/0325135 A1 * 11/2016 Franche ..... A63B 22/16
2017/0165558 A1 * 6/2017 Makai ..... A63C 1/303
2017/0232302 A1 * 8/2017 Dedvukaj ..... A63B 26/003 482/123

* cited by examiner

SKATE SPINNER

This application claims the benefit of the Korean Patent Application No. 10-2017-0117405, filed on Sep. 13, 2017, which is hereby incorporated by reference as if fully set forth herein.

BACKGROUND OF THE INVENTION

Field of the Invention

The present invention relates to a training device that is used for practicing and training for spinning movements in figure-skating on flat surfaces other than ice and, most particularly, the skate spinner (or training device) may allow a user to embody spin movements, which correspond to the same movements performed on ice, even on generally flat ground surfaces outside of the ice, when practicing for the spin movements using the skate spinner, wherein the skate spinner includes a support unit contacting the ground surface and having an overall spherical surface outline, and may allow the user to naturally tilt sideways (i.e., from left to right, and vice versa) in accordance with a shift (or change) in a center of gravity (or weight) according to front-to-back movements of the user's body as well as a shift in the center of gravity according to left-to-right movements of the user's body. Moreover, the skate spinner may also include a support unit configured of a plurality of plates spaced apart from one another at a predetermined constant distance, wherein an edge of each plate retrains the skate spinner from slipping, thereby allowing the skate spinner to maintain the spin movement at almost the same spinning point as a spinning point generated at a beginning of the corresponding spin movement of the skate spinner without sliding along surrounding directions.

Discussion of the Related Art

Figure skating is a type of skating sports that is performed on ice, which a skater gracefully glides on wearing a pair of ice-skates and demonstrates diverse movements requiring both technical accuracy and choreographic perfection and beauty.

Figure skating is an integration of a variety of techniques, such as jumps, spins, steps, and so on. More specifically, the spin movement refers to a technique of spinning in one place. The spin movement includes upright spin, sit spin, camel spin, and so on. More specifically when performing the upright spin, the skater spins in an upright standing position. And, when performing the sit spin, the skater spins in a sitting position on one foot as the skater's spinning axis. When performing the camel spin, the skater spins standing on one foot while bending forward and lifting one leg to form a T shape.

When practicing and training for spin movements in ice rinks, a skater may lack training time due to a limitation in training time provided to the skater. Therefore, the skater may be required to carry out further training in places other than ice rinks. Alternatively, to boost or maintain the skater's sense of spinning before training on the ice, the skater may be required to use a supplemental means of training. As a solution to the above-described requirements, a skate spinner (hereinafter referred to as a training device) has been devised to allow skaters to train for their spin movements on ground. Herein, instead of wearing a pair of skates, the skater (or user) may practice his (or her) spin movements while stepping on a stepping board bare-footed or wearing regular shoes.

However, the related art skate spinner (or training device) was disadvantageous in that it was difficult to maintain the spinning movement in one place. In other words, while practicing the spin movements using the related art skate spinner, the user wearing the skate spinner tended to move to surrounding area while spinning. This will be described in more detail with reference to the accompanying drawings.

FIG. 1 illustrates a perspective view showing a bottom surface of the related art training device. FIGS. 2A and 2B illustrate a cross-sectional view showing a longitudinal section and a transverse section of the related art training device. And, FIGS. 3A and 3B illustrate a plane view showing a revolving (or spinning) flow of the related art training device.

The training device 10 is configured of a platform 20 formed of a flat board, and a support unit 30 having its bottom surface formed in a curved shape and contacting a ground surface.

As a stepping board where a user's foot is placed, the platform 20 is configured to have a length and a width corresponding to a size of the user's foot.

As shown in FIG. 2A, the support unit 30 of the related art training device corresponds to a curved body protruding from a front end to a rear end. Accordingly, the user was capable of easily making balanced movement to and from the front end and the rear end, i.e., along a front-to-back direction. However, since the training device is formed to have a flat structure along a left-to-right direction, i.e., along the left-to-right direction according to the user's viewpoint, as shown in FIG. 2B, based on a central line C, the user was incapable of demonstrating an inclination along a left (L)-to-right (R) direction, as shown FIGS. 3A and 3B. Furthermore, since the related art training device contacts a ground surface to form a vertical line and does not include a separate means preventing the training device from slipping from its contacting surface, this may result in variable factors in the spin movement, as shown in FIG. 3B.

More specifically, when performing the spin movement using ice-skates, the user (or skater) was capable of adjusting left-to-right (or right-to-left) inclination in accordance with an inclination angle formed between the user's leg and the ground surface. However, when performing the spin movement using the related art training device, the user was incapable of adjusting the left-to-right (or right-to-left) inclination. Therefore, the related art training device has limitations in being used as a replacement (or substitute) for ice-skates used for training spin movements. Most particularly, even though the user is actually capable of performing spin movements, due to the lack of a slip-resistance means between the ground surface and the contacting surface of the training device, the user is very likely to deviate from a current spinning center point and move to another spinning center point, in accordance with changes in the user's physical balance. Accordingly, as shown in the drawing, it is apparent that the related training device is disadvantageous in embodying (or demonstrating) a stable spin movement.

SUMMARY OF THE INVENTION

Accordingly, the present invention is directed to a skate spinner that substantially obviate one or more problems due to limitations and disadvantages of the related art.

A technical object of the present invention is to provide a skate spinner (also referred to as a training device) that allows a user to embody spin movements, which correspond to the same movements performed on ice, even on generally flat ground surfaces outside of the ice, when practicing for the spin movements using the skate spinner, wherein the skate spinner includes a support unit contacting the ground surface and having an overall spherical surface outline, and which allows the user to naturally tilt sideways (i.e., from left to right, and vice versa) in accordance with a shift (or change) in a center of gravity (or weight) according to front-to-back movements of the user's body as well as a shift in the center of gravity according to left-to-right movements of the user's body.

Another object of the present invention is to provide a skate spinner that includes a support unit configured of a plurality of plates spaced apart from one another at a predetermined constant distance, wherein an edge of each plate retrains the skate spinner from slipping, thereby allowing the skate spinner to maintain the spin movement at almost the same spinning point as a spinning point generated at a beginning of the corresponding spin movement of the skate spinner without sliding along surrounding directions.

Another object of the present invention is to provide a skate spinner that can prevent spraining of ankles and injury that may follow, which frequently occurred when using the related art skate spinner, by allowing the user to maintain a straight line between his (or her) legs and ankles, when the user's body is tilted, since the skate spinner (or training device) can be freely titled or inclined sideways (i.e., from left to right, and vice versa).

Another object of the present invention is to provide a skate spinner that can prevent injury of the user due to excessive tilting or falling, by configuring a width of the support unit included in the skate spinner to be larger than a maximum width of the user's foot, thereby limiting a level of left-to-right inclination from becoming too excessive.

A further object of the present invention is to provide a skate spinner that can eliminate the inconvenience caused in the related art skate spinner to the user for having to place the skate spinner (or training device) configured to have a top-to-bottom asymmetric structure in an appropriate position corresponding to each foot of the user, by forming a platform of the skate spinner to have the same upper and lower structures or to have symmetric upper and lower structures, so that the training device can be used without being distinguished from a left-side device to a right-side device.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, according to an exemplary embodiment of the present invention, provided herein is a skate spinner including a platform configured of a flat board having a user's foot placed thereon, and a support unit corresponding to a lower part of the platform contacting a ground surface and having a curved protruded shape configuring a curved surface starting from a front end to a rear end, wherein the support unit is configured to have a series of plates each having a thickness equal to at least a thickness of an ice-skate blade and being aligned along a left-to-right direction at a predetermined distance, wherein, when observing a cross-section of the skate spinner taken along a direction being perpendicular to a front-to-rear longitudinal direction of the skate spinner, a height of each plate becomes higher starting from the plates positioned at both side ends of the skate spinner towards the plate positioned at a center of the skate spinner, and wherein an overall bottom surface of the plates contacting the ground surface configure a spherical surface outline.

Preferably, the plate may be configured of a thickness ranging from 2 mm to 6 mm, the thickness range corresponding to the thickness range of an ice-skate blade, and a groove formed between each plate may be formed to have a width equal to or less than a width of the ice-skate blade.

Preferably, the support unit may have a left-to-right width (W1) exceeding a width (W2) of the user's shoe or a width (W3) of the user's foot.

Preferably, a curvature of the support unit configured along a front-to-rear direction and a left-to-right direction may have a radius of curvature ranging from 7.5 to 8.5 feet (ft).

Preferably, based on a front-to-rear longitudinal direction of a flat surface of the platform, an upper width and a lower width of the platform may have the same size or an upper part and a power part of the platform may be symmetrical.

Preferably, the plate may be configured to have an edge formed thereon due to a gap formed between each plate.

Preferably, the support unit may be detachably coupled with the platform.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, the exemplary embodiments of the present invention will be illustrated in the appended drawings and described in detail in the detailed description of the present invention. In describing the present invention, when it is determined that the detailed description on a related disclosed technology may cause ambiguity in the concept (or idea) of the present invention, the detailed description of the same will be omitted for simplicity.

The terms used in the description of the present invention are defined based on their corresponding functions within the present invention. And, since the meaning of such terms may vary in accordance with the intentions or practices of anyone skilled in the art, the definition of the terms used in the description of the present invention should be understood based on the overall context of this specification.

Figure 1:
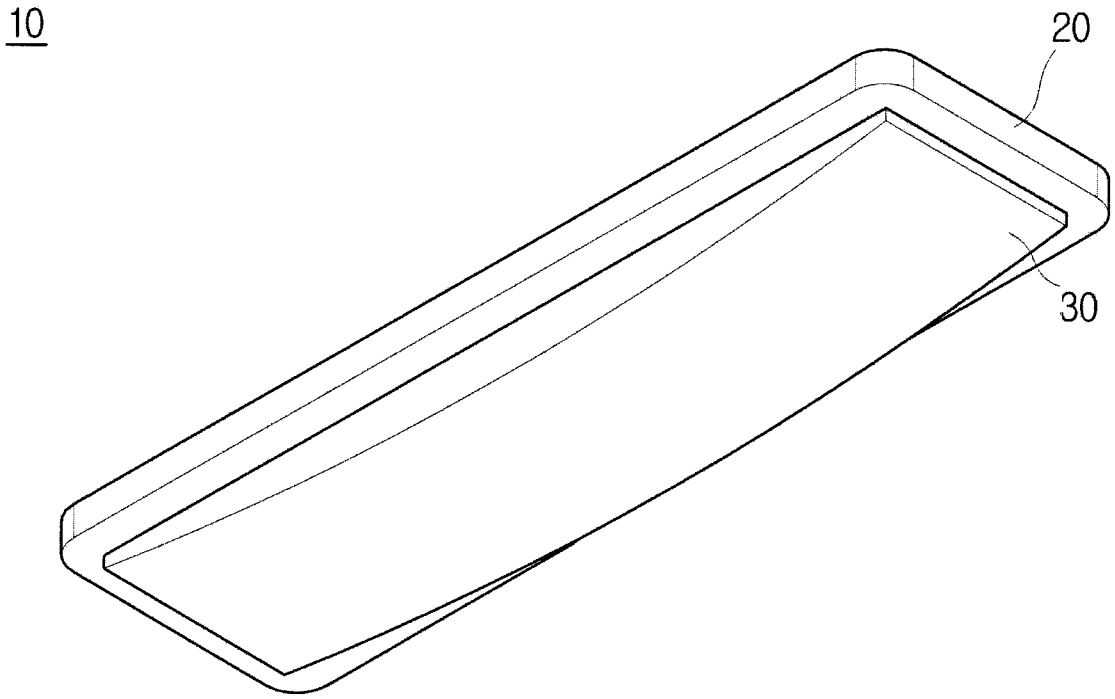
FIG. 1 illustrates a perspective view showing a bottom surface of a training device for describing a prior art.
Figure 2A:
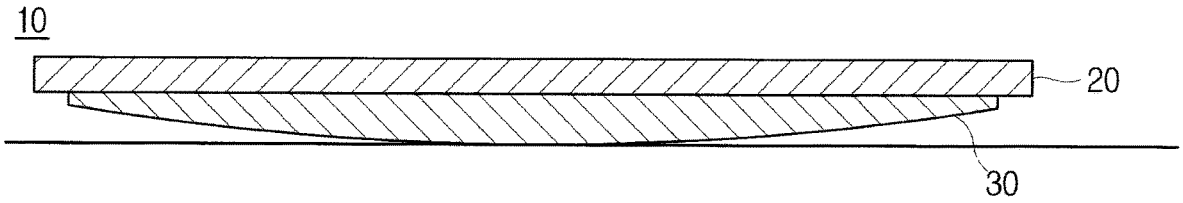
FIGS. 2A and 2B illustrate a cross-sectional view showing a longitudinal section and a transverse section of the training device for describing the prior art.
Figure 2B:
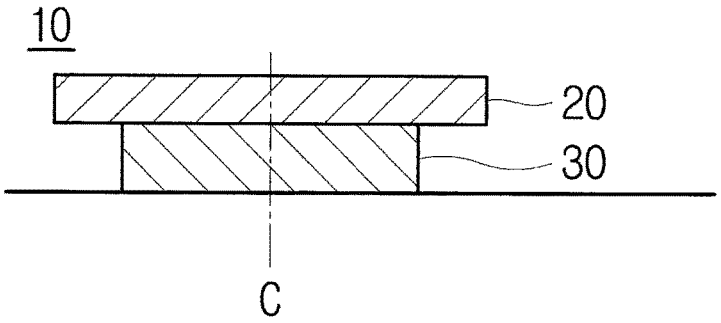
Figure 3A:
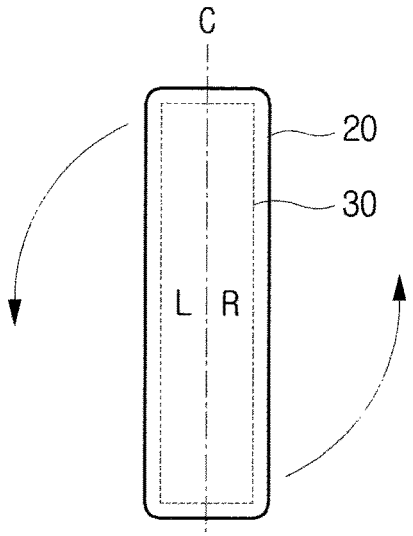
FIGS. 3A and 3B illustrate a plane view showing a revolving (or spinning) flow of the training device for describing the prior art.
Figure 3B:
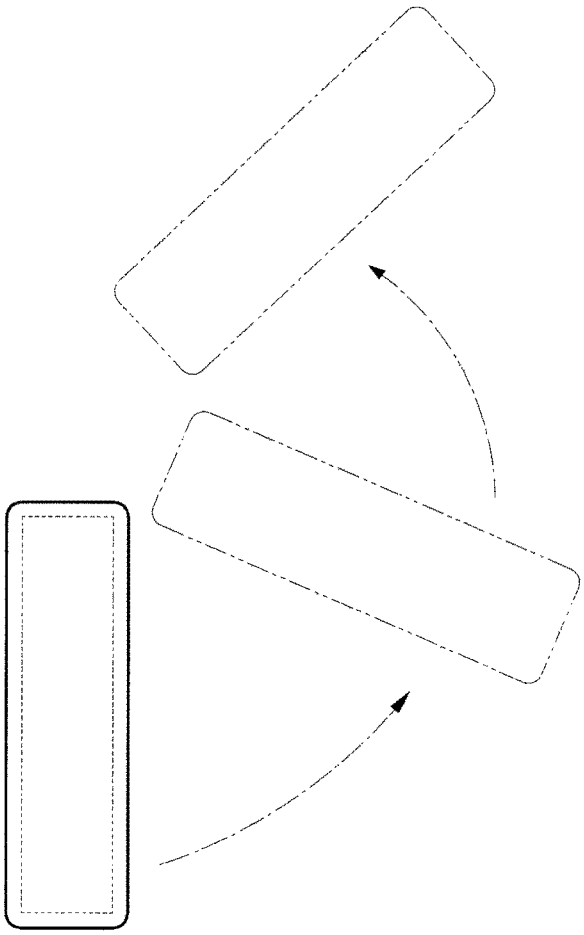
Figure 4:
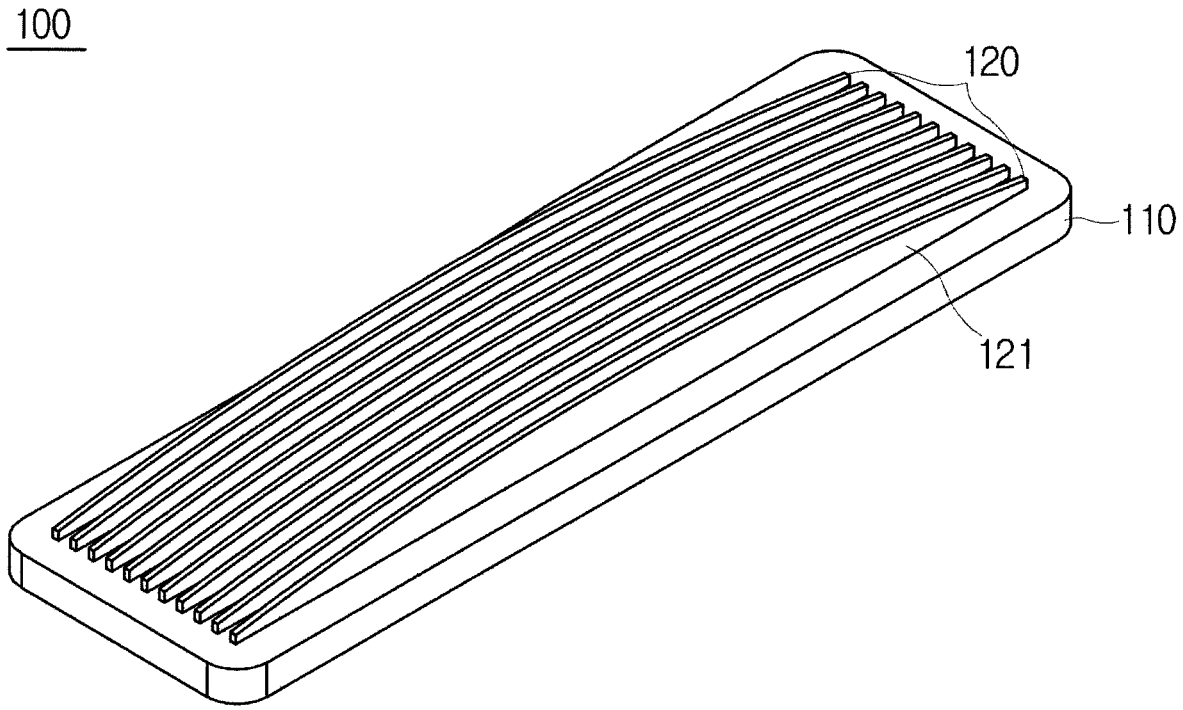
FIG. 4 illustrates a perspective view showing a bottom surface of the training device according to a preferred embodiment of the present invention.
Figure 5A:
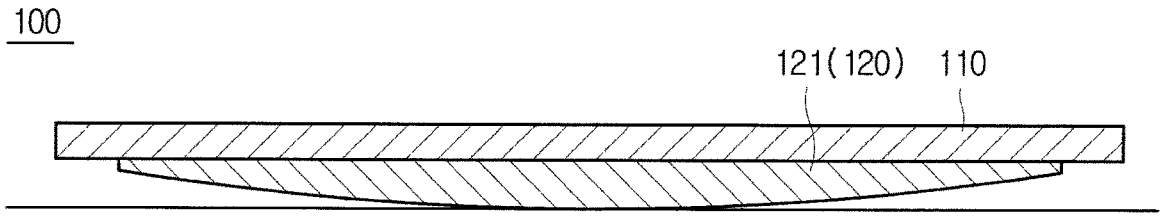
FIGS. 5A to 5C illustrate a cross-sectional view of the training device showing movements of a support unit in accordance with front-to-back (or back-to-front) weight change according to the preferred embodiment of the present invention.
Figure 5B:
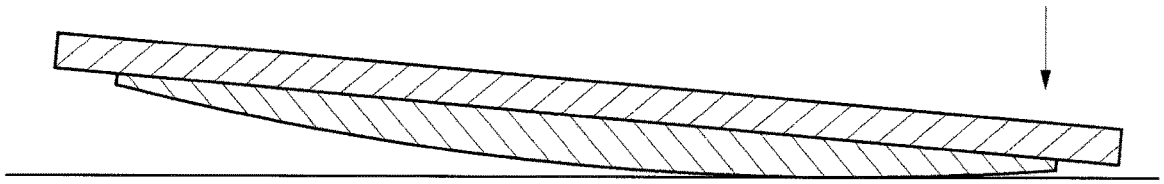
Figure 5C:
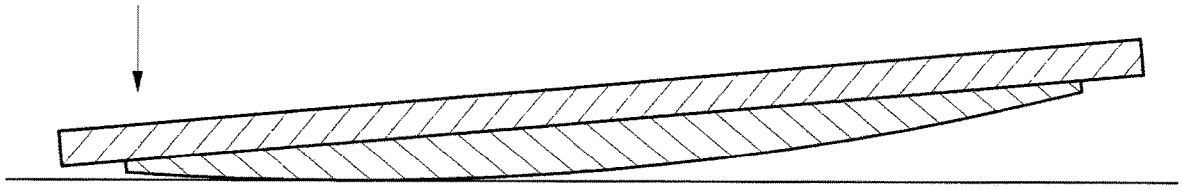

FIG. 4 illustrates a perspective view showing a bottom surface of the training device according to a preferred embodiment of the present invention. And, FIGS. 5A to 5C illustrate a cross-sectional view of the training device showing movements of a support unit in accordance with front-to-back (or back-to-front) weight change according to the preferred embodiment of the present invention.

As shown in the drawing, the training device 100 is configured to include a platform 110 configured of a flat board having a user's foot placed thereon, and a support unit 120 corresponding to a lower part of the platform contacting a ground surface and having a curved protruded shape configuring a curved surface. Although the curved surface will be described in detail later on, the curved surface is generally configured to have a radius of curvature ranging from 7.5 to 8.5 feet (ft). In case the radius of curvature is less than the above-described range, the curvature may become very steep causing an excessive inclination, which may lead to an increase in instability. In case the radius of curvature exceeds the above-described range, the curvature may become relatively flat, which may cause the device to be tilted to an angle that does not sufficiently correspond to the inclination of the user's body when performing the spin movement.

As a stepping board where a user's foot is placed, the platform 100 is configured to have a length and a width corresponding to a size of the user's foot. Although this may be identical to the prior art, the present invention will not be limited only to this. Although it is not shown in the drawing, a means of friction for slip resistance may be further included on a surface where the user's foot is placed, or famous cartoon characters, drawings, patterns, and so on, may be printed or impressed on the training device in order to increase the commercial value of the training device.

Additionally, by embodying the platform 110 to have a wider range of shapes, the platform 110 may be configured of stepping boards formed to have diverse shapes including rectangular shapes, other shapes, a shape of a foot step, and so on. Furthermore, the platform 110 may also be provided with a guide guiding an area where the user's foot is to be placed, thereby inducing a favorable weight dispersion.

At this point, it is preferable that the guide is provided in at least one form selected from printing, impression, and sticker.

Furthermore, based its front-to-back longitudinal direction, a flat surface of the platform 110 may be configured to a width of an upper part and a width of a lower part to be different from one another. Accordingly, the user may be capable of distinguishing the upper part of the platform 110 from the lower part of the platform 110, thereby enabling the user to be consistent in using the training device. Generally, when the user shifts his (or her) center of gravity (or weight), the user may tend to shift toward any one of a leftward direction and a rightward direction more frequently. Therefore, in case of using the training device for a long period of time, a level of abrasion may eventually differ in each surface of the training device. In this case, when the user is accustomed to the surface with a relatively higher level of abrasion, the user may feel discomfort when using a surface having a lower level of abrasion. This may eventually cause a negative effect on the user's performance when practicing his (or her) spin movement. Therefore, by allowing the user to differentiate (or distinguish) the upper part of the platform 110 from the lower part of the platform 110, the user may use his (or her) training device accordingly, thereby enjoying his (or her) consistency in the spin movement.

Figure 6A:
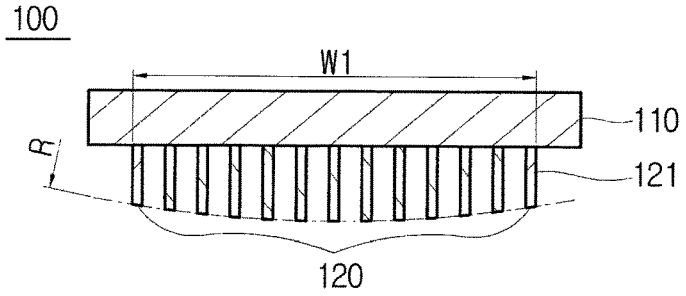
FIGS. 6A to 6C illustrate a longitudinal sectional view of the training device showing a plate alignment state according to the preferred embodiment of the present invention.

As shown in FIG. 6A, the above-described support unit 120 may be configured of a series of plates 121 each having a thickness compatible to a width (or thickness) of an ice-skate blade, preferably, each having a thickness that is equal to the width of the ice-skate blade, and being laterally aligned along a left-to-right (or right-to-left) direction while being spaced apart from one another at equal distances. Herein, the distance between each plate 121 may be wide enough to form a space. Herein, based on a left-to-right direction, a height of each plate 121 gradually increases starting from both side ends towards a center of the support unit 120, while maintaining the same radius of curvature (R).

More specifically, when observing a cross-section of the training device taken along a direction being perpendicular to a front-to-rear longitudinal direction of the training device, a height of each plate becomes higher starting from the plates positioned at both side ends of the training device towards the plate positioned at a center of the training device. At this point, since each plate has a contacting surface contacting the ground surface, wherein the contacting surface is generally configured to have a spherical surface outline, since each plate supports the user's body at the corresponding inclination angle, regardless of the angle of inclination, the user may experience an effect of standing on ice-skate blades. Herein, although it may be advantageous for the distance between each plate to be narrow, so as to enable a continuous movement of the plates, it is preferable to determine the distance between each plate based on a proper functioning of the edge of each plate.

Herein, although the plate 121 is named after the shape of the ice-skate blade, the term plate may also refer to a part where a groove is not formed between each pair of grooves, when a plurality of grooves being aligned along a longitudinal direction of the support unit 120 is serially formed along a left-to-right (or right-to-left) direction, while maintaining a constant distance, and, preferably, while maintaining a constant distance corresponding to the thickness of the ice-skate blade. More specifically, as long as an edge is formed on the plate 121, the shape of the plate 121 is not limited, and a depth of each groove starting from the contacting surface of the plate 121 to a lower surface of the groove is not a concern (i.e., the depth of each groove is not very significant herein).

Therefore, since the center of gravity (or weight) may be distributed along a front-to-back (or back-to-front) direction as well as a left-to-right (or right-to-left) direction, an optimal training environment that is equivalent to training for spin movements on ice wearing ice-skates. And, most particularly, by forming grooves between each plate 121, only the bottom surface of each plate 121 contacts the ground surface, thereby minimizing the contacting surface and ultimately enhancing a rotational force of the spin movement.

Figure 6B:
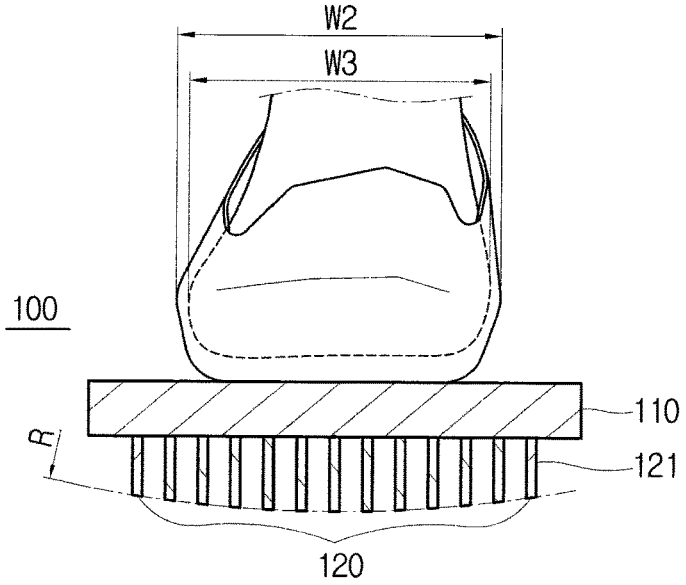
Figure 6C:
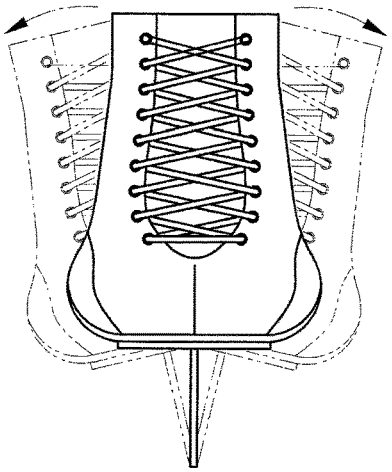
Figure 7A:
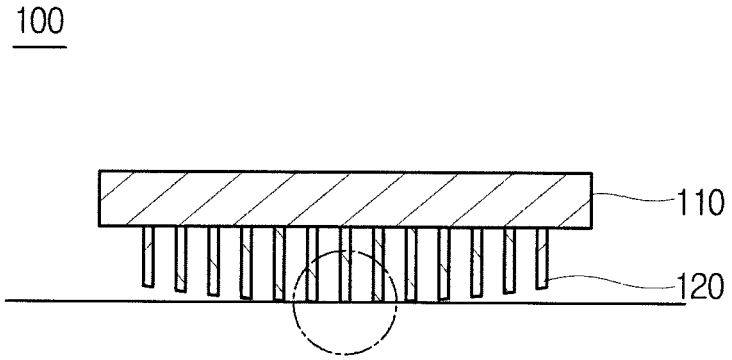
FIGS. 7A to 7C illustrate a longitudinal sectional view of the training device showing movements of a support unit in accordance with left-to-right (or right-to-left) weight change according to the preferred embodiment of the present invention.
Figure 7B:
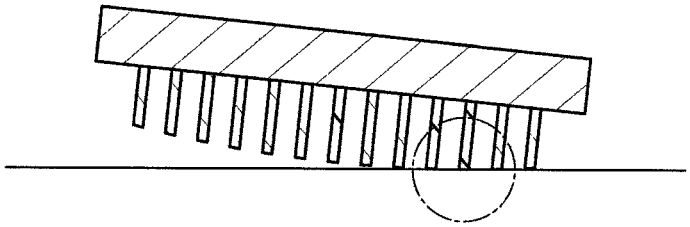
Figure 7C:
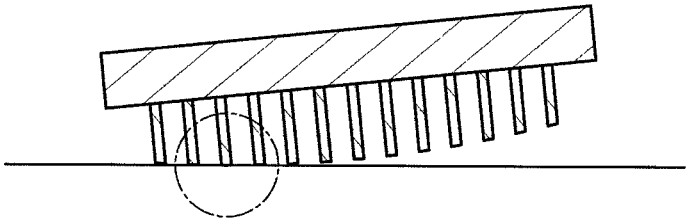

Additionally, as shown in FIG. 6C, since movements corresponding to a leftward or rightward inclination of the ice-skate can be embodied, when the user practices for his (or her) spin movements, a stable spin may be maintained, even when the spin movement is performed while centering along the left-to-right (or right-to-left) direction of the support unit 120, as shown in FIG. 7A, or even when the spin movement is focused to the right side, as shown in FIG. 7B, or focused to the left side, as shown in FIG. 7C.

Figure 8A:
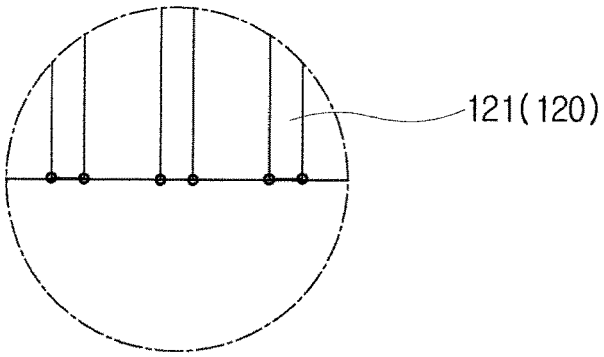
FIGS. 8A to 8C illustrate a detailed view of plates showing a slip resistant state of the training device according to the preferred embodiment of the present invention.
Figure 8B:
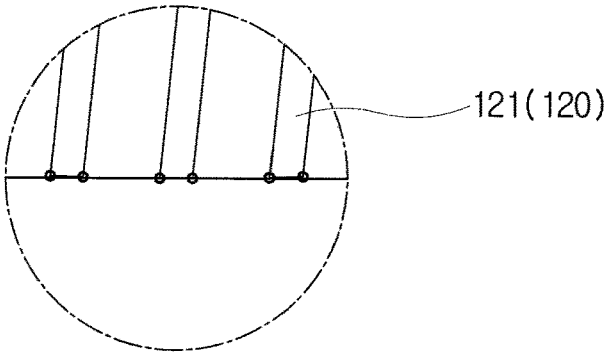
Figure 8C:
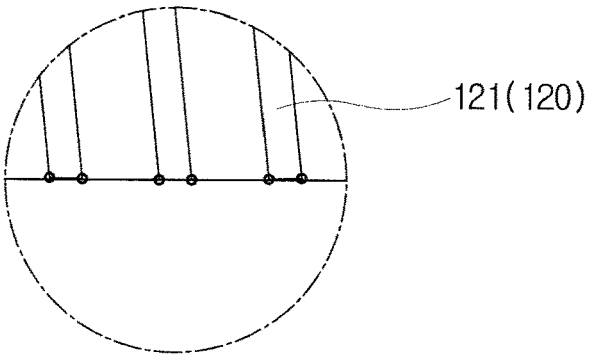

Additionally, the support unit 120 is configured of a plurality of plates 121, as shown in FIGS. 8A to 8C, wherein an edge of at least one plate 121 being approximate to or contacting the ground surface causes friction with the ground surface, thereby restraining the training device 100 from deviating from its spinning center point and moving (or sliding) to another position. Accordingly, when the training device 100 spins, a stable spinning may be embodied along the center of gravity (or weight) without deviating from its spinning point as much as possible.

More specifically, FIG. 8A is a detailed view of FIG. 7A. As shown in FIG. 8A, when the central plate 121 contacts the ground surface and spins, in case the plate is tilted leftward or rightward, the edge of a plate 121 being adjacent to the central plate 121 along the tilted direction contacts the ground surface, thereby restraining the training device 100 from deviating from the spinning point and sliding to another point.

Additionally, FIG. 8B is a detailed view of FIG. 7B. As shown in FIG. 8B, when the central plate 121 contacts the ground surface and spins, in case the plate is tilted rightward due to the centrifugal force, the edge of a plate 121 being adjacent to the central plate 121 along the rightward direction contacts the ground surface, thereby restraining the training device 100 from deviating from the spinning point and sliding to another point.

Furthermore, FIG. 8C is a detailed view of FIG. 7C. Since FIG. 8C is symmetrical to FIG. 8B, a detailed description of the same will be omitted for simplicity.

Meanwhile, as shown in FIGS. 6A and 6B, it is preferable that a width (W1) of the support unit 120 is larger than a width (W2) of the user's shoe, in case the user uses the training device 100 while wearing shoes, or it is preferable that a width (W1) of the support unit 120 is larger than a width (W3) of the user's foot, in case the user uses the training device 100 bare-footed. In this case, since it is difficult for a bearing power (or bearing capacity) of the user's foot to be delivered to an outermost plate 121 of the support unit, this may act as another solution for preventing the training device 100 from being excessively tilted leftward or rightward.

Moreover, in order to maintain an optimal spinning condition, a thickness of an ice-skate blade is generally configured to range from 2 mm to 6 mm. Accordingly, it is preferable that a thickness of the plate 121 is also configured to range from 2 mm to 6 mm. The thickness range of the plate 121 is determined in accordance with the case of practicing spin movements on ice wearing ice-skates in order to provide a most similar environment when practicing off the ice. However, in case the thickness of the ice-skate blade is smaller than the range of 2 mm to 6 mm, or in case the thickness of the ice-skate blade larger than the range of 2 mm to 6 mm, the thickness of the plate 121 may also vary accordingly.

Although it is not shown in the drawing, the support unit 120 including the plates 121 may be formed as a single body with the platform 110. However, unlike the above-described structure, the support unit 120 may be detachably fixed to the platform 110 to provide support by using a general detachably fixing method. This is to allow only the support unit 120 to be independently replaced. Since the platform 110 does not directly contact the ground surface, its level of abrasion is very low even if the training device 100 is used for a long period of time. On the other hand, since the support unit 120 directly contacts the ground surface, when used for a long period of time, its level of abrasion becomes very high.

Figure 9A:
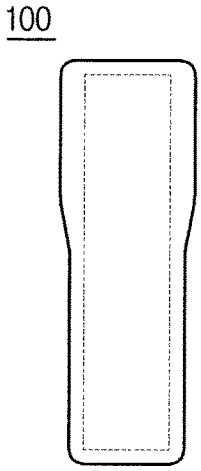
FIGS. 9A to 9C illustrate examples of a stepping board of the training device, wherein the stepping board is vertically asymmetrical and vertically symmetrical, according to the preferred embodiment of the present invention.
Figure 9B:
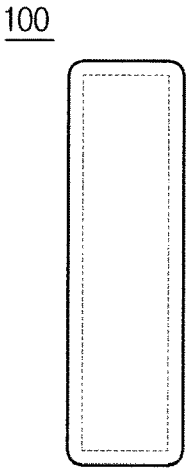
Figure 9C:
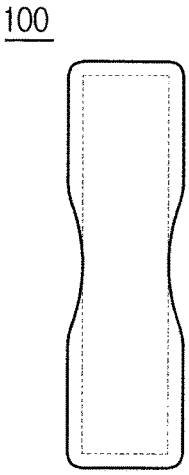

Meanwhile, the platform 110 according to the present invention corresponds to an enhanced version of a top-to-bottom asymmetric structure (i.e., vertically asymmetric structure) of the related art, which is shown in FIG. 9A. In case the platform 110 is formed to have a top-to-bottom asymmetric structure, the platform 110 is generally formed in a shape of a foot, which corresponds to a structure having a large upper width and a small lower width, as shown in FIG. 9A. However, this structure is disadvantageous in that, each time the training device 100 is used, the user is required to place the upper part of the training device 100 facing forward on the ground surface. However, according to the present invention, as shown in FIGS. 9B and 9C, since the platform 110 is formed to have identical upper and lower parts based on a central line between the upper and lower parts, or since the platform 110 is formed to have a top-to-bottom symmetric structure (i.e., vertically symmetric structure), there is no position reference for placing the training device 100 on the ground surface. Thus, the inconvenience of having to place the training device 100 on the ground surface in its appropriate position is eliminated.

As described above, the skate spinner has the following advantages. According to the present invention, the skate spinner (or training device) may allow a user to embody spin movements, which correspond to the same movements performed on ice, even on generally flat ground surfaces outside of the ice, when practicing for the spin movements using the skate spinner, wherein the skate spinner includes a support unit contacting the ground surface and having an overall spherical surface outline, and may allow the user to naturally tilt sideways (i.e., from left to right, and vice versa) in accordance with a shift (or change) in a center of gravity (or weight) according to front-to-back movements of the user's body as well as a shift in the center of gravity according to left-to-right movements of the user's body.

Additionally, the skate spinner according to the present invention may include a support unit configured of a plurality of plates spaced apart from one another at a predetermined constant distance, wherein an edge of each plate retrains the skate spinner from slipping, thereby allowing the skate spinner to maintain the spin movement at almost the same spinning point as a spinning point generated at a beginning of the corresponding spin movement of the skate spinner without sliding along surrounding directions.

Additionally, the skate spinner according to the present invention may prevent spraining of ankles and injury that may follow, which frequently occurred when using the related art skate spinner, by allowing the user to maintain a straight line between his (or her) legs and ankles, when the user's body is tilted, since the skate spinner (or training device) can be freely titled or inclined sideways (i.e., from left to right, and vice versa).

Additionally, the skate spinner according to the present invention may prevent injury of the user due to excessive tilting or falling, by configuring a width of the support unit included in the skate spinner to be larger than a maximum width of the user's foot, thereby limiting a level of left-to-right inclination from becoming too excessive.

Furthermore, the skate spinner according to the present invention may eliminate the inconvenience caused in the related art skate spinner to the user for having to place the skate spinner (or training device) configured to have a top-to-bottom asymmetric structure in an appropriate position corresponding to each foot of the user, by forming a platform of the skate spinner to have the same upper and lower structures or to have symmetric upper and lower structures, so that the training device can be used without being distinguished from a left-side device to a right-side device.

It will be apparent to those skilled in the art that various modifications and variations can be made in this specification without departing from the spirit or scope of this specification. Thus, it is intended that this specification covers the modifications and variations of this invention provided they come within the scope of the appended claims and their equivalents. It is also apparent that such variations of this specification are not to be understood individually or separately from—the technical scope or spirit of this specification.

What is claimed is:

1. A skate spinner, comprising:

a platform configured to support a user's foot, the platform having a rectangular shape with a predetermined length and a predetermined width shorter than the predetermined length; and a supporter provided below the platform and extending along a longitudinal direction of the platform, the supporter having a bottom contacting a ground surface, wherein the supporter includes a plurality of plates protruding from a bottom of the platform toward the ground surface and extending along the longitudinal direction of the platform with predetermined grooves formed therebetween in a lateral direction of the platform, wherein the bottom of the supporter has a first curvature along the longitudinal direction of the platform and the first curvature is continuously formed from a front end to a rear end of the supporter, wherein the bottom of the supporter has a second curvature along the lateral direction of the platform and the second curvature is constant from a right end to a left end of the supporter, and wherein the bottom of the supporter has a spherical contour entirely.

2. The skate spinner of claim 1, wherein each plate has a thickness ranging from 2 mm to 6 mm, and wherein each groove formed between each plate is formed to have a width equal to or less than a width of an ice-skate blade.

3. The skate spinner of claim 1, wherein the second curvature has a radius of curvature ranging from 7.5 to 8.5 feet.

4. The skate spinner of claim 1, wherein a width of a front portion of the platform and a width of a rear portion of the platform have the same size or the front portion and the rear portion are symmetrical.

5. The skate spinner of claim 1, wherein each plate is configured to have an edge formed thereon.

6. The skate spinner of claim 1, wherein the supporter is detachably coupled with the platform.

7. The skate spinner of claim 1, wherein the platform is configured to support only one of the user's feet.

8. The skate spinner of claim 1, wherein a width of a front portion of the platform is greater than a width of a rear portion of the platform.

9. The skate spinner of claim 1, wherein a bottom of each plate has the first curvature formed continuously from a front end to a rear end of each plate.

10. The skate spinner of claim 1, wherein, when observing a cross-section of the supporter taken along the lateral direction of the platform, a height of each plate becomes higher starting from plates positioned at both of the right and left ends of the supporter towards a plate positioned at a center of the supporter.

* * * * *